US009707608B2

(12) United States Patent
Sperrer

(10) Patent No.: US 9,707,608 B2
(45) Date of Patent: Jul. 18, 2017

(54) METHOD FOR BENDING A WORKPIECE

(71) Applicant: TRUMPF Maschinen Austria GmbH & Co. KG, Pasching (AT)

(72) Inventor: Gerhard Sperrer, Oberschlierbach (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 0 days.

(21) Appl. No.: 14/431,050

(22) PCT Filed: Sep. 25, 2013

(86) PCT No.: PCT/AT2013/050195

§ 371 (c)(1),
(2) Date: Mar. 25, 2015

(87) PCT Pub. No.: WO2014/047669

PCT Pub. Date: Apr. 3, 2014

(65) Prior Publication Data

US 2015/0266073 A1 Sep. 24, 2015

(30) Foreign Application Priority Data

Sep. 26, 2012 (AT) ..... A 1051/2012

(51) Int. Cl.
*B21D 5/02* (2006.01)
*B21D 5/00* (2006.01)
*C21D 8/02* (2006.01)

(52) U.S. Cl.
CPC ..... *B21D 5/008* (2013.01); *B21D 5/004* (2013.01); *B21D 5/02* (2013.01); *B21D 5/0281* (2013.01); *C21D 8/0294* (2013.01)

(58) Field of Classification Search
CPC ..... B21D 5/004; B21D 5/008; B21D 5/02; B21D 22/022; B21D 37/16; B21D 22/208;
(Continued)

(56) References Cited

U.S. PATENT DOCUMENTS 1,251,578 A 1/1918 Riecken
2,893,459 A 7/1959 Kosek
(Continued)

FOREIGN PATENT DOCUMENTS

AT 508 357 A4 1/2011
DE 1160 815 B 1/1964
(Continued)

OTHER PUBLICATIONS

International Examination Report of PCT/AT2013/050195, mailed Feb. 6, 2014.

*Primary Examiner* — Edward Tolan
(74) *Attorney, Agent, or Firm* — Collard & Roe, P.C.

(57) ABSTRACT

The invention relates to a method for bending a workpiece (1) of sheet metal, whereby a deformation region (6), in particular a strip-shaped region, on the workpiece (1) containing the bent edge to be produced (5) is heated before and/or during the bending process to a deforming temperature below the fusion temperature of the metal to increase deformability locally. In order to reduce undesirable deformation due to shrinkage stress, the workpiece (1) is heated before and/or during and/or after the bending operation in at least one heating zone (11) that is different from the deformation region (6) by means of the application of energy from outside the workpiece (1) starting from an initial temperature to a processing temperature below the fusion temperature of the metal.

22 Claims, 3 Drawing Sheets

Figure 1:
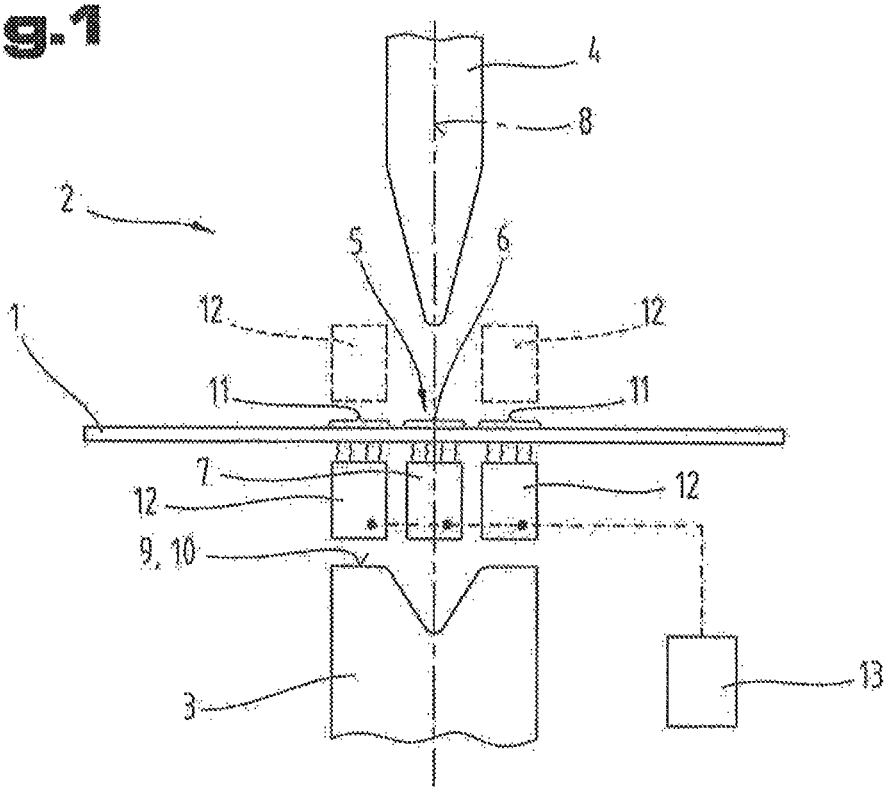

(58) Field of Classification Search
CPC ..... B21D 5/00; B21D 5/01; C21D 8/0294; C21D 8/0494; C21D 2221/10
See application file for complete search history.

(56) References Cited

U.S. PATENT DOCUMENTS

| | | | | |
|---|---|---|---|---|
| 5,256,218 | A | 10/1993 | Bakalyar et al. | |
| 5,359,872 | A | 11/1994 | Nashiki | |
| 6,415,639 | B1 | 7/2002 | Kilian et al. | |
| 6,550,302 | B1 * | 4/2003 | Ghosh | B21D 22/00 72/342.7 |
| 7,104,105 | B2 * | 9/2006 | Buttner | B21D 53/24 72/335 |
| 8,646,302 | B2 * | 2/2014 | Lety | B21D 22/02 72/342.7 |
| 2008/0196800 | A1 * | 8/2008 | Beenken | B21D 22/022 148/643 |
| 2011/0146854 | A1 * | 6/2011 | Nasserrafi | B21D 22/20 148/670 |
| 2012/0067100 | A1 * | 3/2012 | Stefansson | B21D 5/00 72/342.1 |
| 2012/0160002 | A1 | 6/2012 | Bammer et al. | |
| 2012/0167649 | A1 | 7/2012 | Bammer et al. | |
| 2012/0168992 | A1 | 7/2012 | Bammer et al. | |
| 2013/0333190 | A1 | 12/2013 | Mizumura et al. | |

FOREIGN PATENT DOCUMENTS

| | | | | | |
|---|---|---|---|---|---|
| DE | 42 28 528 | A | | 3/1993 | |
| DE | 196 20 196 | A1 | | 11/1997 | |
| EP | 0 648 555 | A1 | | 4/1995 | |
| EP | 0 993 345 | A1 | | 4/2000 | |
| GB | 897 818 | A | | 5/1962 | |
| JP | 2-247018 | A | * | 10/1990 | B21D 5/01 |
| JP | 5-96329 | A | * | 4/1993 | B21D 5/01 |
| JP | H05 177366 | A | | 7/1993 | |
| JP | 6-238336 | A | * | 8/1994 | B21D 5/01 |
| WO | 2011/000011 | A1 | | 1/2011 | |
| WO | 2011/000013 | A1 | | 1/2011 | |
| WO | 2012/118223 | A1 | | 9/2012 | |

* cited by examiner

METHOD FOR BENDING A WORKPIECE

CROSS REFERENCE TO RELATED APPLICATIONS

This application is the National Stage of PCT/AT2013/050195 filed on Sep. 25, 2013, which claims priority under 35 U.S.C. §119 of Austrian Application No. A 1051/2012 filed on Sep. 26, 2012, the disclosure of which is incorporated by reference. The international application under PCT article 21(2) was not published in English.

The invention relates to a method for bending workpieces of sheet metal, whereby a deformation region on the workpiece, in particular a strip-shaped region, containing the bent edge to be produced is heated before and/or during the bending process to a deforming temperature below the fusion temperature of the metal in order to increase deformability locally.

Bending workpieces by means of bending presses is a common and long used, reliable method for processing workpieces by deformation. However, the range of applications in which bending methods can be used is limited to a certain extent by the properties of the materials, in particular by mechanical-technological properties. In the case of brittle materials such as magnesium, titanium, spring steels, high-strength Al alloys, high-strength steels or other known brittle materials, for example, the problem which occurs during deformation by bending is that these materials do not have a sufficiently plastic deformability and therefore break during the bending process or tears or other undesired deformations occur along the deformation region. One characteristic variable which provides information about the behavior of materials in this respect is the so-called elongation at break, in other words the value of the plastic deformation which the workpiece to be deformed can withstand as a maximum before a break occurs. Another alternative characteristic variable for this behavior is the so-called tensile yield strength ratio, which expresses the stress in a workpiece necessary at the start of a perceptible plastic deformation as a ratio of the maximum stress which the workpiece can withstand at breaking load.

Even in the case of workpieces made from materials with good deformability, the deformability may be too low if bending radii have to be produced which are very small relative to the sheet thickness, e.g. if the bending radius is approximately within the range of the sheet thickness or even smaller, in which case the stress which the material can withstand may be exceeded on the tension side of the deformation region.

A commonly used method of enabling such materials having a lower elongation at break or workpieces with relatively large sheet thicknesses to be processed by a forming method, in particular bending, is to heat the workpieces to be bent in the area of the deformation region, as a result of which the stress in this heated region needed to achieve the requisite plastic deformation can be locally reduced.

As one example of such a method, EP 0 993 345 A1 discloses a method of bending a workpiece by the effect of mechanical force whereby the workpiece is selectively heated along a bending line by laser radiation and a linear radiation field is formed by a laser beam or several laser beams and the workpiece is heated by the radiation field at all points along the bending line.

Although forming can be made easier or even made possible at all by localized selective heating of the deformation region on the workpiece containing the bent edge to be produced, shrinkage stress often occurs when the deformation region is subsequently cooled, leading to undesired changes in shape on the workpiece, in particular thermal distortion, warping, waving or buckling, making such workpieces unusable or creating the need for complex finishing work.

The objective of the invention is to propose a bending method of the generic type which prevents or at least reduces the problematic effects of heating outlined above.

This objective of the invention is achieved by a method as described herein.

Due to the fact that the workpiece is heated before and/or during and/or after the bending operation in at least one heating zone that is different from the deformation region by applying energy from outside the workpiece starting from an initial temperature up to a processing temperature below the fusion temperature of the metal, the distribution of shrinkage stress which occurs when only the deformation region is heated can be influenced so that gentler stress patterns occur and the resultant shrinkage stress can be at least partially compensated. As a result, cooling of the deformation region can be easily slowed down because dissipation of heat from the deformation region is reduced due to the higher temperature of the adjacent heating zone and the spread of internal stress to the limbs of the workpiece adjoining the bent edge produced is reduced.

Due to the heat conduction taking place within a workpiece during implementation of the method, the processes whereby heat spreads are primarily non-stationary but if the process parameters governing the way energy is applied to the heating zone or to the deformation region as well are controlled in a special way, approximately quasi-stationary states can be created, at least temporarily. Due to heat conduction processes within the workpiece, temperature differences are naturally compensated after energy has been applied, and the terms deformation region and heating zone therefore relate to a point in time when the deforming temperature or processing temperature is significantly higher in these regions than in parts of the workpiece that are not heated.

A computed estimation of the thermal stress created in the workpiece due to temperature changes and the deformation caused as a result can be obtained with the aid of constantly improved simulation computations, e.g. FE methods, and, based on computer models, optionally also incorporating measurements taken whilst implementing the method, in other words before and/or during and/or after the actual forming operation, it is also possible by applying energy accordingly to create a temperature distribution in the workpiece that will enable undesired residual deformation after the cooling process to be eliminated or reduced.

Due to the additional heating zone next to the actual deformation region, thermal deformation and distortions which occur can also be reduced before the forming operation already because the gradient of stress occurring within the workpiece is lower. Due to reduced deformation, positioning of the workpiece on the bending die is also made easier or less complicated.

An advantageous method which may be used to apply energy to the heating zone may be selected from a group comprising heat transfer, heat conduction, thermal radiation, convection, electromagnetic induction, electrical resistance heating, laser radiation, high-power electromagnetic radiation, or a combination of these. The use of laser radiation in particular enables a rapid and precise increase in temperature in the heating zone because the radiation emitted by a laser light source can be flexibly adapted in terms of its intensity and the area on which it acts by using appropriate means to guide the beam.

Energy may be applied to the heating zone from a point at a distance away from the deformation region, which means that a greater distance will offer more options when it comes to choosing what means will be used to apply the energy. This makes it easier to heat the deformation region and heating zone simultaneously.

In the case of workpieces in which portions of identical dimensions adjoin the bend edge, it is of advantage if two or more heating zones are created substantially symmetrically with respect to the deformation region, thereby preventing deformation due to asymmetrical shrinkage stress.

Taking account of the development of the temperature curve over time due to heat conduction, it may be of advantage if the processing temperature has a predefined temperature distribution with different temperature values on completion of applying energy within a heating zone.

In order to reduce the time needed to heat the workpiece in the heating zone, energy may advantageously be applied from both sides of the sheet. This reduces heating time in the case of thicker sheets in particular. Applying energy from both sides of the sheet means that more surface is available for this purpose and the heating power can be increased whilst maintaining the same intensity of the energy applied. The risk of local overheating to the point of reaching the fusion temperature of the metal sheet can be kept low as a result.

A temperature distribution which can be easily planned or set, optionally by computer, can be obtained if the heating zone is set as being oriented parallel with the bend edge or deformation region.

If a length of the heating zone in the direction parallel with the bend edge is set as being shorter than the bend edge length, the heated peripheral region not directly heated by the applied energy close to the end of the bend edge will undergo less expansion and contraction than the adjacent deformation region and heating zone, as a result of which there will be a more gentle transition in the spread of stress to parts of the workpiece not thermally affected.

Due to the heat conduction taking place in the workpiece, it is not necessary to apply the requisite energy evenly within the entire heating zone in order to obtain a specific processing temperature and instead, it is also possible to apply energy to the heating zone to several mutually spaced apart heating portions. This enables the use of one or more locally acting heat sources to heat the heating zone rather than using a heat source acting on the full surface. This means that a resistance heating element lying in a flat position can be replaced by a controllable laser beam, for example.

Since a uniform processing temperature within the heating zones is desired in most cases, it is of advantage if the heated portions within the heating zone are selected so that they are essentially uniformly distributed. This applies not just to the spatial distribution and extent but also means that the energy applied to the heated portions is also largely identical.

A temperature distribution in the workpiece which can easily be planned or set, optionally by computer, can be obtained if the application of energy to at least one heated portion is effected substantially along a line or alternatively at one point.

A uniform temperature distribution and a readily calculatable or computable curve of temperature over time can be obtained if energy within the heating zone is applied to all of the heated portions of the heating zone simultaneously. This enables any computer models used to work out the energy applied to be made simpler.

As an alternative, energy can be applied to individual heated portions consecutively in time, thereby enabling a flat heating zone to be heated by means of an energy source which acts locally in spatial terms.

To enable a temperature distribution to be obtained that is as uniform as possible even if the heated portions are heated consecutively one after the other, it is possible to opt for mutually overlapping heated portions.

The deformation region may also be heated to the deforming temperature by applying energy to the heating zone so that heat is conducted through the workpiece as a result when the requisite deforming temperature is reached, thereby obviating the need for a separate heating device for the deformation region.

In order to reduce the mechanical equipment needed to implement the method, it is of advantage if the energy source used to heat the deformation region is also used at a later point in time to apply energy to the heating zone. Given that the requirements involved in heating the deformation region and heating zone are similar, this approach may be used in many situations.

In the case of very thin metal sheets which can cool very rapidly in the ambient air, it may be helpful to heat the heating zone and deformation region by means of a separate energy source in each case.

As already mentioned above, with a view to minimizing undesired deformation of the workpiece, it may be of advantage to set at least one process parameter selected from a group comprising position, shape, expansion, processing temperature or temperature distribution of the heating zone, distribution, duration or intensity of the energy applied by means of a programmable control device. To this end, models of the cooling behavior and associated thermal stress or thermally induced deformation which can be adapted to the respective application are stored in the control device.

In particular, such a process parameter may be set using a finite elements method.

The method may be further improved if the process parameter is set by taking a measurement of the geometry and/or temperature of the workpiece before and/or during and/or after the forming operation, as a result of which the method results can be optimized by resetting controlled variables. The method is therefore controlled in such a way that undesired thermally induced deformation after cooling is minimized.

Shape faults on the workpiece can be effectively minimized if the intensity and duration of the applied energy is selected so that a processing temperature from a range of between 220° C. and 600° C. is obtained in the heating zone and/or heated portion substantially through the entire thickness of the metal sheet.

Another option is to select the intensity and duration of the applied energy so that a processing temperature is obtained in the heating zone and/or heated portions at which a change in the structure of the metal sheet occurs. Such changes in structure may influence the distribution of stress within the workpiece so that the absolute values of forming faults on the workpiece are reduced. For example, creating several regions of inhomogeneity in the structure of the sheet metal can lead to a situation in which shrinkage stress does not lead to any major fault in the workpiece but rather several smaller faults or slight undulations which may constitute tolerable faults, depending on the case.

A particularly rational approach to implementing the method is possible if at least some of the energy applied to the heating zone is applied by means of a bending tool used for the bending operation. For example, in a bending die on which the workpiece is placed before the forming operation, there is a possibility of applying high-power radiation, in particular laser radiation, and the workpiece is positioned above the emitted radiation by means of a robot so that the heating process takes place in the deformation region and/or heating zone.

If a laser cutting means is linked up to a bending press, it is also possible for at least some of the energy applied to the heating zone to be applied during a cutting process on the laser cutting means prior to the bending operation.

The method can be used to particular advantage for bending operations on workpieces of sheet metals with a zinc base, titanium base, aluminum base, as well as composite materials incorporating such elements or workpieces where the ratio of the smallest bending radius and sheet thickness is less than 1.0.

To provide a clearer understanding, the invention will be described in more detail below with reference to the appended drawings.

Figure 2:
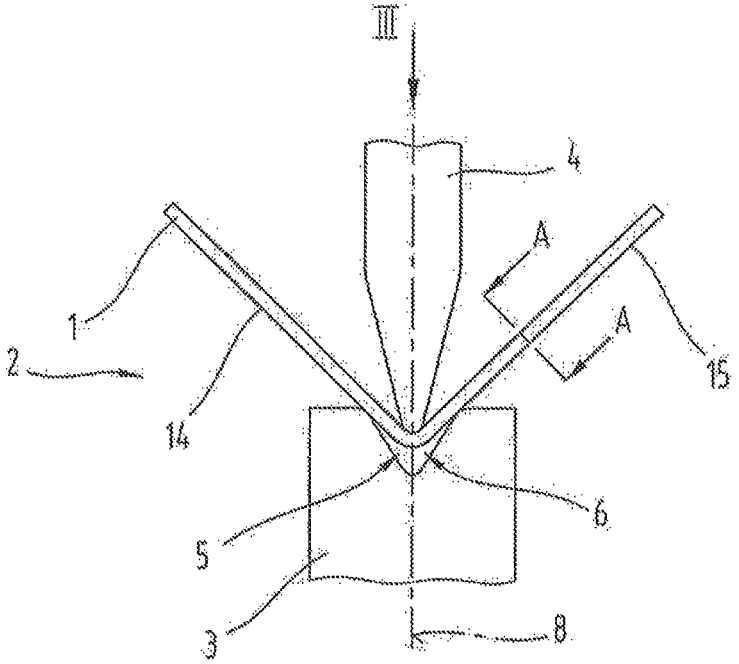
Figure 3:
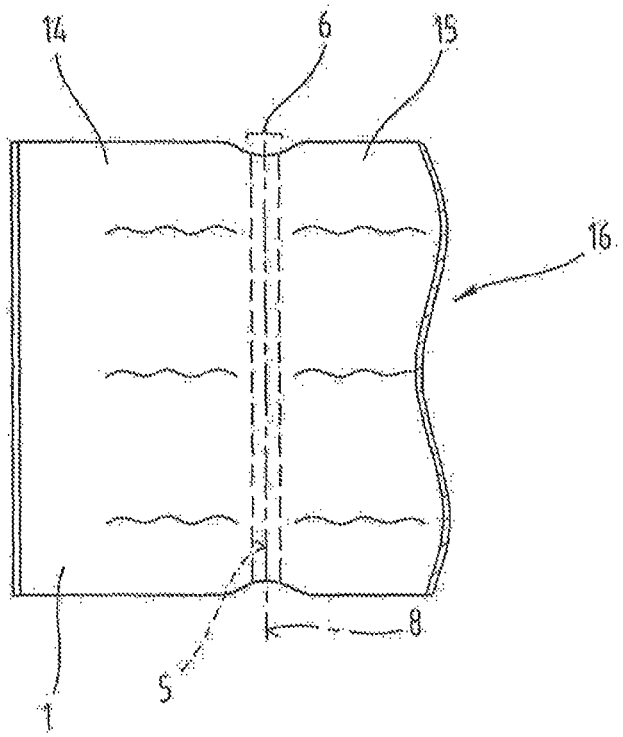
Figure 6:
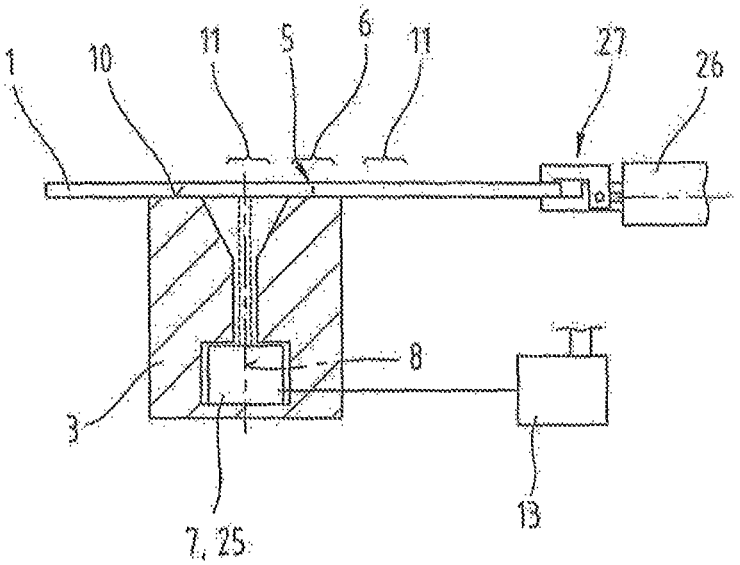
Figure 4:
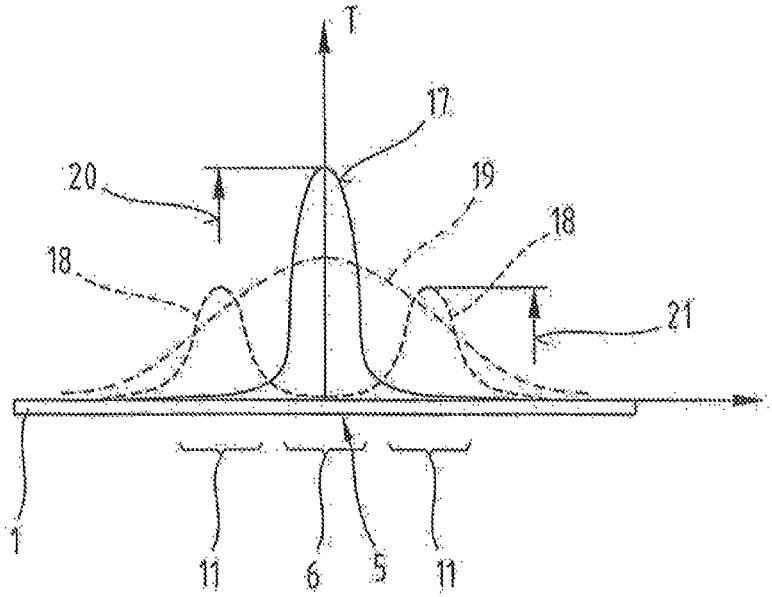
Figure 5:
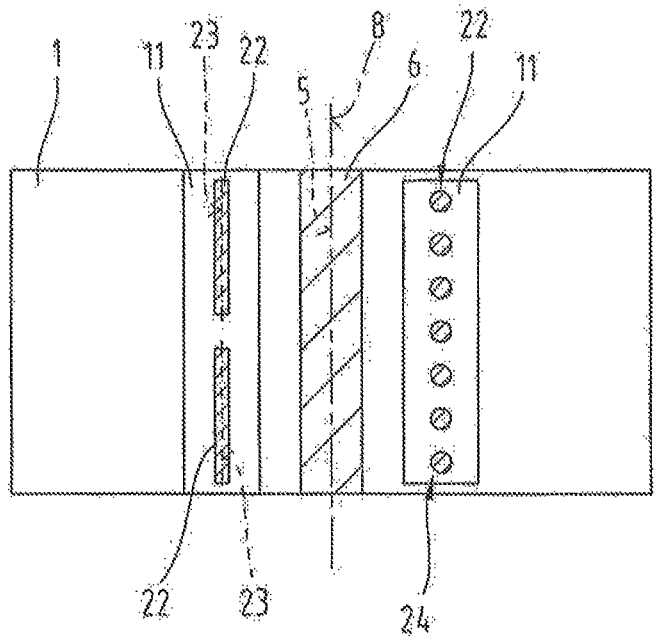

These are highly schematic, simplified diagrams illustrating the following:

FIG. 1 a method for bending workpieces during heating of the deformation region and heating zone;

FIG. 2 a method for bending workpieces on completion of the forming operation;

FIG. 3 a view in partial section in direction III of a finished, bent workpiece from FIG. 2;

FIG. 4 a view of a workpiece to be bent showing possible variants of the heating zone;

FIG. 5 a diagram of a possible temperature distribution within a workpiece to be formed, after heating the heating zone;

FIG. 6 a section through a bending die which can be used to implement the method.

Referring to FIGS. 1 and 2, a description will be given of a method for bending a workpiece 1 of sheet metal. To this end, before the forming operation, a workpiece 1 is placed in a bending tool arrangement 2 comprising a bending die 3, for example in the form of a V die, and a bending punch 4, which can be moved towards one another by means of a guiding and driving arrangement of a bending machine, not illustrated, and thus create a bend edge 5 on the workpiece 1 by plastic deformation.

In order to increase the deformability of the workpiece 1, a deformation region 6 which will ultimately contain the bend edge 5 is heated to a deforming temperature below the fusion temperature of the metal of the workpiece 1 by means of a heating device 7. Heating the deformation region 6 enables degrees of bending to be obtained on the workpiece 1 that would not be possible at room temperature for example, because the workpiece 1 would possibly tear or break. As a result of heating, the level of stress with effect from which a plastic deformation starts to occur in the workpiece 1 is reduced, and for this reason the optimum deforming temperature is set depending on the material of the workpiece 1 used in each case. The method may be used to particular advantage for sheet metals with a zinc base, titanium base, aluminum base, or for workpieces where the ratio of the smallest bending radius and sheet thickness is less than 1.0.

The heating device 7 causes energy to be applied to the deformation region 6 of the workpiece and for this purpose a mechanism selected from a group comprising heat transfer, heat conduction, thermal radiation, convection, electromagnetic induction, electrical resistance heating, laser radiation, high-power electromagnetic radiation may be used or a combination of these.

As illustrated in FIG. 1, the heating device 7 and what will be the subsequent bend edge 5 are positioned in the bending plane 8, which also coincides with the direction in which the displaceable bending punch 4 is moved. Once the heating operation has been completed, the heating device 7 is removed from the immediate working area of the bending tool arrangement 2 and the workpiece 1 is moved into the intended position for the forming operation. To this end, in the normal situation, it is placed on the top face 9 of the bending die 3, which also constitutes a support plane 10. However, it would also be possible for the operation of heating the deformation region 6 to be carried out at a distance away from the bending tool arrangement 2, in which case the workpiece 1 is moved across a short distance into the requisite position for the forming operation in which what will subsequently be the bend edge 5 is lying in the bending plane 8. The deformation region 6 is heated in such a way that the workpiece 1 still has the desired increased deformability even after a short positioning movement. To achieve this, the cooling that will take place after the end of the heating operation can be estimated and the deformation region 6 heated accordingly to a higher temperature.

As proposed by the invention, in addition to the deformation region 6 on the workpiece 1, at least one heating zone 11 is also heated by applying energy from outside the workpiece 1 starting from an initial temperature to a processing temperature below the fusion temperature of the workpiece 1. In the embodiment illustrated as an example, two heating zones 11 disposed approximately symmetrically with respect to the bending plane 8 are heated. In this instance, the energy is applied by heating devices 12 disposed adjacent to the heating device 7 for the deformation region 5 and also act on the bottom face of the workpiece 1, although it would also be possible for the heating zones 11 to be heated to the processing temperature by other heating devices 12 positioned above the workpieces 1 which act simultaneously from both sides of the workpiece. In this instance, the energy is applied from both sides of the workpiece 1, which means that the time needed for the heating operation can also be reduced.

The heating devices 12 for heating the heating zones 11 may also be disposed at a distance away from the bending tool arrangement 2 and the workpiece 1 is moved into the requisite position for the forming operation after the heating operation has been terminated.

As illustrated in FIG. 1, the heating device 7, 12 may be provided in the form of a source of high-power radiation, in particular laser radiation, although alternative thermal energy sources could also be used, such as, for example, resistance heating elements, infrared radiators, hot air devices with a concentrated air outlet, etc.

The heating zones 11 may also be heated in such a way that the heating device 7 is then used at a different time to heat the deformation region 6. This being the case, the amount of equipment needed to implement the method is reduced.

The heating devices 7, 12 are preferably activated by a programmable control device 13, by means of which the heating operations can be controlled so that the requisite temperatures, in other words the deforming temperature in the deformation region 6 and the processing temperature in the heating zone 11, can be obtained and maintained as accurately as possible. The control device 13 may also be connected to a control device, not illustrated, of the bending machine containing the bending tool arrangement 2 or may be part thereof.

The control device 13 activates the application of heat to the heating zone 11 and sets it based on a selection from a group comprising position, shape, extent or processing temperature of the heating zone or also distribution, duration and intensity of the energy applied. The control device 13 may also influence the energy applied to the heating zone 11 on the basis of an automatic positioning movement of the heating devices 7, 12, and this automatic movement may also include the removal of the heating devices 7, 12 from the working area of the bending tool arrangement 2.

The process parameters can also be set by the control device 13 using a finite elements method in particular, by means of which the stress created in the deformation region 6 when the workpiece 1 is being heated and cooled is estimated or computed in advance and the energy applied to the heating zones 11 is set on this basis so that the stress which occurs when cooling the workpiece 1 after the forming operation is minimized or compensated.

Another option is to set process parameters based on a measurement of the geometry of the workpiece 1 or the temperature of the workpiece 1 in the deformation region 6 or in the heating zone 11. In particular, the heating operation may be implemented using a temperature measuring device activated during the heating operation, e.g. a contactless radiation thermometer, and a regulating device.

To ensure that the deformability of the workpiece 1 in the deformation region needed to run a bending operation without problems is obtained, a specific temperature is required in the deformation region 6 at the end of the heating operation, and allowance must be made for the fact that because of heat conduction within the workpiece 1 and heat given off to the environment, the temperature in the deformation region 6 drops. This being the case, it is of advantage if the time between terminating the heating operation and completion of the forming operation is as short as possible, for which reason it is of advantage to carry out the heating operation in the vicinity of the bending tool arrangement or in the bending tool arrangement 2.

In one embodiment of the method, it may be that deformation region 6 is heated to the deforming temperature by heat conduction during or after the application of energy to the heating zone 11 by the heating device 12. In this case, a separate heating device 7 for heating the deformation region 6 may be dispensed with.

To prevent undesired forming faults on the workpiece, the intensity and duration of the energy applied by means of the heating devices 7, 12 is selected so that a processing temperature within a range of between 220° C. and 600° C. is obtained in the heating zone 11. This temperature should effectively prevail essentially throughout the entire thickness of the workpiece 1.

FIG. 2 illustrates how the bending tool arrangement 2 acts on the workpiece 1, the end of the forming operation being shown as an example in this instance. At this point in time, the deformation region 6 is at a higher temperature than parts of the workpiece 1 that were not heated and the temperature inside the workpiece 1 is still balancing out and heat continues to be given off to the ambient environment and bending tool arrangement 2.

The temperature distribution prevailing in the workpiece 1 on completion of the forming operation then determines what shrinkage stress will occur in the workpiece 1 and the undesired deformation that will be induced as a result. As a result of the invention, this cooling process is advantageously influenced by the heating zones 11 other than the deformation region 6 and heating of the heating zone 11 may take place before and/or during and/or after the actual forming operation.

An explanation will be given below with reference to FIGS. 3, 4 and 5 as to how the shrinkage stress which occurs in the workpiece 1 is influenced as proposed by the invention.

FIG. 3 shows a view in direction III of a bent workpiece 1, the right-hand bend limb being illustrated in section along line A-A indicated in FIG. 2. As explained above, for the purpose of a bending operation of the generic type, the deformation region 6 that will subsequently contain the bend edge 5 is heated before and/or during the forming operation, thereby imparting the requisite deformability to the workpiece 1 locally in the region of the bend edge 5.

During heating of the strip-shaped deformation region 6 and due to the local increase in temperature, the material in this region undergoes a thermal expansion which is impeded to a greater or lesser degree by the adjoining workpiece portions that were not heated to such a high degree or were not heated at all. This causes compressive stress in the area of the deformation region, which would build back up again during subsequent cooling of the workpiece 1 and cause the associated contraction of the deformation region 6. However, because the workpiece 1 is formed in the heated state and the plastic deformation occurring in the region of the bend edge 5 results in the internal stress being largely eliminated in the longitudinal direction of the bend edge 5, subsequent cooling of the deformation region 6 in a formed workpiece 1 causes shrinkage in the longitudinal direction of the bend edge 5, which is impeded to a greater or lesser degree by the adjoining workpiece portions. Once the workpiece 1 has cooled to ambient temperature, this results in tensile stress (shrinkage stress) in the area of the deformation region 6, which causes undesired deformation of the adjoining workpiece portions and the adjoining bend limbs 14 and 15 or even the bend edge 5. In FIG. 3, such deformations are illustrated as undulations 16 on an exaggerated scale. Other shapes might naturally also occur, for example a single camber or curvature or a similar undesired shape fault, which can be significantly reduced or prevented with the aid of the method proposed by the invention.

FIG. 4 illustrates possible temperature distributions within a workpiece 1 when the method is implemented.

In the deformation region 6 that will subsequently contain the bend edge 5, there is an area with a significantly increased temperature T because the workpiece 1 was heated, as described above, before or during the forming operation to the deforming temperature, which is significantly higher than the ambient temperature. This relatively narrowly delimited and sharp temperature pattern 17 in the deformation region 6 naturally spreads due to heat conduction taking place in the workpiece 1 once the heating operation has ended. However, there is also a significantly increased temperature in this region after the forming operation, which causes the shrinkage stress described above and hence the associated undesired changed in the shape of the finished workpiece 1.

As proposed by the invention, in addition to the deformation region 6, the workpiece 1 is heated in a heating zone 11 on the workpiece 1—in FIG. 4 two heating zones 11 disposed symmetrically with respect to the bend edge 5—to a processing temperature below the fusion temperature of the metal, which results in other temperature distributions 18 in isolated areas, which change due to the cooling behavior of the workpiece 1. This additional temperature increase in the heating zones 11 causes the deformation region 6 to cool much more slowly after having reached the deforming temperature and the rapid flow of heat into the rest of the workpiece 1 is rendered much slower as a result. The much steeper original temperature distribution 17 where there are no heating zones 11 is replaced by a much broader temperature distribution 19 in this case and, because of the significantly less steep temperature gradient and due to a much slower cooling speed, the internal stress induced by cooling is greatly reduced so that the undesired thermal deformation which occurs on the bent workpiece 1 is also greatly reduced.

As indicated in FIG. 4, the deforming temperature 20 in the deformation region 6 is selected so that it is significantly higher than the processing temperature 21 in the heating zones 11 but it would also be possible for the processing temperature 21 and deforming temperature 20 to be approximately the same or the processing temperature 21 could also be higher than the deforming temperature 20. As already described above, another option is for the deformation region 6 not to be heated separately but instead to be brought to the corresponding deforming temperature due to heat conduction within the workpiece 1 emanating from the heating zones 11.

FIG. 5 is a view of an unbent workpiece 1 showing possible embodiments of heating zones 11. The deformation region 6 containing what will ultimately be the bend edge 5 in the region of the bending plane 8 is indicated by broken lines. Spaced at a distance apart from it on the left-hand side is a heating zone 11, where energy is applied by two mutually spaced apart heated portions 22. Accordingly, it is not necessary for energy to be applied uniformly or to the entire heating zone 11 and instead heating may take place via several mutually spaced apart heated portions 22 due to the heat conduction that will occur anyway and the distribution of the temperature on completion of the heating operation. In this example, energy is applied to the heated portions 22 along lines 23 extending more or less parallel with the bending plane 8, as a result of which the heating zone 11 likewise extends approximately parallel with the bend edge 5. To the right of the bend edge 5 is a remote second heating zone 11, where the heated portions 22 to which energy is essentially applied are indicated by a row of points 24. In order to obtain a temperature distribution within a heating zone 11 that is as easy as possible to determine, including by computer, it is of advantage if several heated portions 22 are disposed in a regular sequence or uniformly. The disposition of heating zones 11 illustrated in FIG. 5 would more or less result in the temperature distribution described in connection with FIG. 4, which reduces undesired thermal deformation on the finished workpiece 1.

FIG. 6 illustrates another and optionally independent embodiment of the method for bending a workpiece 1, the same component names and reference numbers being used to denote parts that are the same as those described above in connection with FIGS. 1 to 5. To avoid unnecessary repetition, reference may be made to the more detailed description given above in connection with FIGS. 1 to 5.

In this embodiment, the deformation region 6 that will ultimately contain the bend edge 5 and the heating zones 11 disposed on either side of it are heated by means of a heating device 7 integrated in the bending die 3, preferably comprising a laser light source 25 or means for distributing laser radiation generated and transmitted to them from outside the bending die 3. The workpiece is positioned and handled manually or, as illustrated, by means of a programmable handling device 26, which is equipped with a gripper 27, for example. When the bottom face of the workpiece 1 is placed on the support surface 10 of the bending die 3, as illustrated, deformation due to the natural weight of the workpiece 1 is reduced and at the same time the potentially dangerous escape of laser radiation is largely prevented.

The deformation region 6 and the two heating zones 11 are heated one after the other by the same heating device 7, and the sequence may be freely selected. To make it easier to obtain the deforming temperature 20 in the deformation region 6 and maintain it until completion of the forming operation, it is of advantage if the deformation region 6 is heated after the heating zones 11. Using an integrated arrangement in one of the bending tools of the bending tool arrangement 2, the energy can even be applied during the actual forming operation.

Finally, it should be pointed out that in the different embodiments described, the same parts are denoted by the same reference numbers and component names, and disclosures made throughout the description can be literally applied to the same parts denoted by the same reference numbers and component names. Furthermore, the positions chosen for the purposes of the description, such as top, bottom, side, etc., relate to the drawing specifically being described and can be transposed in terms of meaning to a new position when another position is being described.

The embodiments illustrated as examples represent possible variants of the method, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the devices used to implement the method, they and their constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1, 2; 3; 4; 5; 6 constitute independent solutions proposed by the invention in their own right. The objectives and associated solutions proposed by the invention may be found in the detailed descriptions of these drawings.

Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

LIST OF REFERENCE NUMBERS

1 Workpiece
2 Bending tool arrangement
3 Bending die

4 Bending punch
5 Bend edge
6 Deformation region
7 Heating device
8 Bending plane
9 Top face
10 Support plane
11 Heating region
12 Heating device
13 Control device
14 Bend limb
15 Bend limb
16 Undulation
17 Temperature distribution
18 Temperature distribution
19 Temperature distribution
20 Deforming temperature
21 Processing temperature
22 Heated portion
23 Line
24 Dot
25 Laser light source
26 Handling device
27 Gripper

The invention claimed is:

1. Method for bending a workpiece of sheet metal along a bending edge between a bending die and a bending punch of a bending tool arrangement, whereby a strip-shaped deformation region on the workpiece containing the bent edge to be produced is heated in a first time period before and/or during the bending process to a deforming temperature below the fusion temperature of the metal via a heating device integrated in the bending die to increase deformability of the workpiece locally, wherein the workpiece is heated in a second time period before and/or after the bending operation in at least one heating zone that is different from said strip-shaped deformation region via the application of energy from outside the workpiece by said heating device integrated in the bending die to raise the temperature of said at least one heating zone, starting from an initial temperature to a processing temperature below the fusion temperature of the metal, wherein said heating device integrated in the bending die heats said strip-shaped deformation region and said at least one heating zone one after the other such that the first time period does not overlap the second time period, and wherein said workpiece is positioned and handled in relation to said heating device manually or via a programmable handling device.

2. Method according to claim 1, wherein the energy is applied using a mechanism selected from a group consisting of heat transfer, heat conduction, thermal radiation, convection, electromagnetic induction, electrical resistance heating, laser radiation, high-power electromagnetic radiation, and a combination thereof.

3. Method according to claim 1, wherein the energy is applied to said at least one heating zone from a distance away from said strip-shaped deformation region.

4. Method according to claim 1, wherein said at least one heating zone comprises two or more heating zones disposed substantially symmetrically with respect to the deformation region.

5. Method according to claim 1, wherein the processing temperature within said at least one heating zone is brought to a predefined temperature distribution with locally different temperature values.

6. Method according to claim 1, wherein the energy is applied from both sides of the workpiece.

7. Method according to claim 1, wherein said at least one heating zone is set so that it is oriented parallel with the bent edge.

8. Method according to claim 1, wherein the energy is applied to said at least one heating zone in several mutually spaced apart heated portions.

9. Method according to claim 8, wherein the several mutually spaced apart heated portions within said at least one heating zone are substantially uniformly distributed.

10. Method according to claim 8, wherein the energy is applied to a heated portion of said several mutually spaced apart heated portions, said heated portion being arranged substantially along a line.

11. Method according to claim 8, wherein the energy is applied to a heated portion of said several mutually spaced apart heated portions, said heated portion being arranged substantially at one point.

12. Method according to claim 8, wherein the energy is applied to all the heated portions of said several mutually spaced apart heated portions of said at least one heating zone simultaneously.

13. Method according to claim 8, wherein the energy is applied to individual heated portions of said several mutually spaced apart heated portions at different times one after the other.

14. Method according to claim 13, wherein the individual heated portions mutually overlap.

15. Method according to claim 1, wherein at least one process parameter selected from a group consisting of position, shape, extent or processing temperature of the heating zone, and distribution, duration or intensity of the applied energy is set via a programmable control device.

16. Method according to claim 15, wherein the process parameter is set using a finite elements method.

17. Method according to claim 15, wherein the process parameter is set after measuring the geometry and/or the temperature of the workpiece before and/or after the forming operation.

18. Method according to claim 1, wherein the intensity and duration of the energy applied is selected so that a processing temperature from a range of between 220° C. and 600° C. is obtained in said at least one heating zone and/or heated portions substantially throughout the entire thickness of the workpiece.

19. Method according to claim 1, wherein the intensity and duration of the energy applied is selected so that a processing temperature is obtained in said at least one heating zone and/or heated portions which causes a change in the structure of the workpiece compared with the initial temperature.

20. Method according to claim 1, wherein at least some of the energy applied to said at least one heating zone is applied via a bending tool used for the bending operation.

21. Method according to claim 1, wherein at least some of the energy applied to said at least one heating zone is applied during a cutting process on a laser cutting device prior to a bending operation.

22. Method according to claim 1, wherein the sheet metal has a zinc base, or has a titanium base, or has an aluminum base, or is a composite material incorporating at least one of zinc, titanium, and aluminum, or has a ratio of a smallest bending radius to sheet thickness of less than 1.0.

* * * * *